US005501775A

United States Patent [19]

Kotitschke et al.

[11] Patent Number: 5,501,775

[45] Date of Patent: Mar. 26, 1996

[54] WET PRESS FOR A PAPER MAKING MACHINE

[75] Inventors: Gerhard Kotitschke, Steinheim; Christian Schiel, Heidenheim, both of Germany

[73] Assignee: J. M. Voith GmbH, Germany

[21] Appl. No.: 184,592

[22] Filed: Jan. 21, 1994

[30] Foreign Application Priority Data

Jan. 23, 1993 [DE] Germany ..... 43 01 750.9
Jun. 26, 1993 [DE] Germany ..... 43 21 405.3

[51] Int. Cl.[6] ..... D21F 3/02

[52] U.S. Cl. ..... 162/360.3

[58] Field of Search ..... 162/358.3, 360.3, 162/205, 360.2; 100/163 R

[56] References Cited

U.S. PATENT DOCUMENTS

| | | | |
|---|---|---|---|
| 2,694,348 | 11/1954 | Beachler | 162/360.2 |
| 3,584,570 | 6/1971 | Sass et al. | 100/163 R |
| 3,861,996 | 1/1975 | Dorfel | 162/360.3 |
| 4,075,056 | 2/1978 | Ely et al. | 162/360.3 |
| 4,086,131 | 4/1978 | Rempel et al. | 162/205 |
| 4,285,766 | 8/1981 | Kankaanpaa | 162/360.3 |
| 4,483,745 | 11/1984 | Wicks et al. | 162/205 |
| 4,556,451 | 12/1985 | Ely | 162/205 |
| 4,988,410 | 1/1991 | Meinecke et al. | 162/360.3 |
| 5,178,732 | 1/1993 | Steiner et al. | 162/360.3 |
| 5,256,257 | 10/1993 | Schiel | 162/360.3 |

*Primary Examiner*—Karen M. Hastings
*Attorney, Agent, or Firm*—Ostrolenk, Faber, Gerb & Soffen

[57] ABSTRACT

A wet press for a paper making machine presses out water from a moist paper web. The wet press has a plurality of press rolls, preferably five. The press rolls are paired so that each pair defines a respective press nip. There are preferably at least four press nips defined by the paired press rolls. The press rolls are so placed and the press nips are so defined and the web is so trained on the path through the wet press that the paper web is always supported by the outer surface of one of the press rolls on the web path from the first press nip to the last press nip. At the second press nip in the path of the web, each of the press rolls there forms a felt free second press nip and each of the press rolls at the second nip has a closed outer surface. The same may be true for the fourth press nip. Some of the press rolls may be shoe press rolls.

5 Claims, 4 Drawing Sheets

WET PRESS FOR A PAPER MAKING MACHINE

BACKGROUND OF THE INVENTION

The present invention relates to a wet press for a paper making machine and particularly to a press with several press nips and wherein the web is supported on its path between the nips, sometimes without a supporting felt belt.

A press of this type is known from U.S. Pat. No. 4,556,451. This press is comprised of four press rolls which form a continuous chain so that the web of paper is always wrapped around a press roll over a part of the circumference of the roll during passage through the press. A total of three press nips are formed by the four press rolls. Upstream of the four roll press, there is a two roll press which receives the paper web coming from the wire section of the paper making machine.

A large number of paper making machine press sections of quite different configurations are known. U.S. Pat. No. 2,694,348 discloses a press section in which the web of paper is first removed by a first felt belt or first felt from the wire section of the paper machine and is then conducted by that first felt through a first two roll press. A second felt belt, which also passes through the first two roll press, receives the web of paper and conducts it through a second two roll press. Thereupon the web of paper is taken up by a third felt belt which passes through the second two roll press. The third felt belt conducts the web of paper through a third two roll press and then further through a fourth two roll press. This press section thus has a total of four press nips. Felt belts are passed through all of the press nips simultaneously along with the web of paper. The web of paper is transported by the felt belts between the individual press nips, over a path on which a felt belt bridges over each free path together with the web of paper present on the felt belt or hanging from it.

In general, wet presses or entire wet press sections should be adapted to the high demands of high speed paper machines. Wet presses should have a high pressing efficiency, should take up as little space as possible, particularly in the direction of travel of the paper web and in the horizontal direction, and furthermore should be of inexpensive construction.

However, with the increasing speeds of modern paper making machines, technical problems become greater, and new problems must constantly be solved. Such problems occur, for instance, upon restarting the paper making machine after it has been stopped, when a narrow strip of paper or tail must be passed through the press section. Furthermore, the danger of the paper web tearing increases with increasing speed of the paper machine. Furthermore, with this increasing speed, the water removal capacity of the press section must be increased. That cannot be done without increasing the number of press nips. However, this requires more space in the direction of travel of the paper machine. Another problem is marking of the paper web by the press felt belts while the web is still moist. Finally, wearing of the press felt belts increases with increasing speed of the machine and increasing linear pressures in the press nips, so that the felt belts must be more frequently replaced by new ones, which naturally increases the cost.

SUMMARY OF THE INVENTION

The foregoing problems have not been optimally solved by known devices. The object of the present invention therefore is so to develop a wet press having a series of press nips in succession and without the web being unsupported by one of the press rolls in such a manner that, while the press has a high degree of pressing efficiency and operates at high speeds, dependable transfer of the narrow lead strip or tail or of the entire wide paper web is assured, the marking of the moist paper web by felts or wires or with hole patterns of suction rolls is reduced or avoided entirely, and the wear of the felt is reduced.

This object is achieved by the invention. A wet press for a paper making machine presses out water from a moist paper web. The wet press has a plurality of press rolls, at least four and preferably five. The press rolls are paired, such that each pair defines a respective press nip. There are at least three and preferably at least four press nips defined by the paired press rolls. The press rolls are so placed, the press nips are so defined and the web is so trained on the path through the wet press that the paper web is always supported by an outer surface of a press roll on the web path from the first press nip to the last press nip. In the successive press nips, e.g. at the second press nip in the path of the web, each of the press rolls there forms a felt free second press nip, and where there is no felt supporting the web at the second nip, each of the press rolls at the second nip has a closed outer surface.

Other objects and features of the invention are explained with reference to the drawings.

DESCRIPTION OF THE PREFERRED EMBODIMENTS

Figure 1:
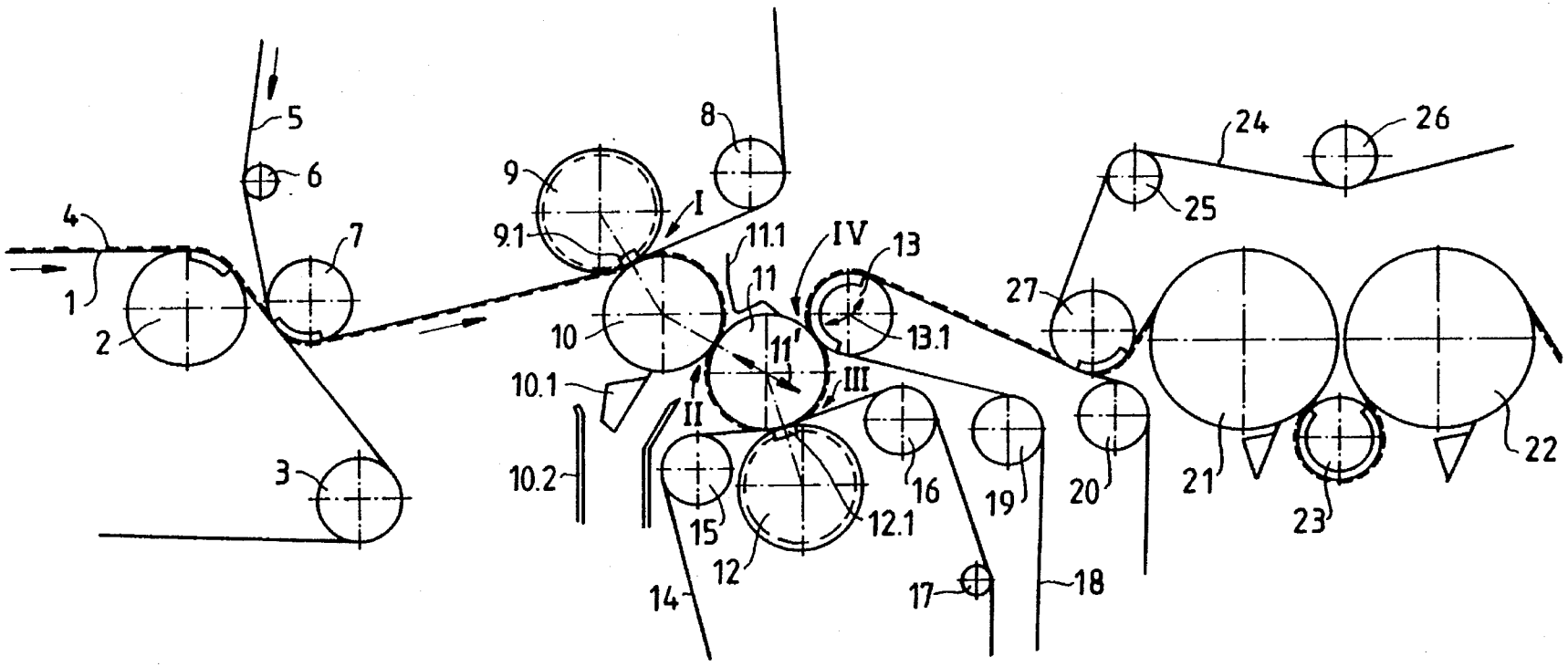
FIG. 1 schematically shows a press section having a five roll press which contains two shoe press or extended nip press rolls.

In FIG. 1, a forming section wire screen 1 in an endless belt form travels in the direction indicated by the arrow and wraps around a suction roll 2 and then around a deflection roll 3 which rolls define an oblique path between rolls 2 and 3. The wire screen 1 carries a paper web 4 on its outer surface, and the web is indicated in dashed line.

There is a first felt 5, which is also developed as an endless loop felt belt. The felt 5 is wrapped around a number of guide rolls, including the guide roll 6, the suction guide roll 7, and the guide roll 8, and further passes around a first press roll 9, which is part of the press.

The first press roll 9 forms a first press nip I with a second press roll 10. The first press roll 9 is a shoe press roll having a press shoe 9.1, which is shown only diagrammatically here. It produces a press nip which is relatively long or extended in the direction of travel of the felt. The press shoe 9.1 is displaceable radially in known manner relative to a stationary support member (not shown), so that the pressing force which acts in the press nip I is variable. The first roll 9 includes a tubular, flexible, press jacket which also travels through the press nip I. The jacket slides over the press shoe 9.1. Its outer surface may have fine recesses (for instance, blind holes) for temporary storage of water. Those recesses are indicated symbolically by a dashed line around the roll 9.

The second press roll 10 is followed in sequence in the web path by a third press roll 11. The two press rolls 10 and 11 are directly contacted by the paper web 4 without a felt on either side of the web. The rolls 10 and 11 form a felt free second press nip II. Press roll 11 is mounted for being displaceable in the directions indicated by the double headed arrow 11', which enables adjustment of the pressing force in the press nip II.

The third press roll 11 is followed in the web path by a fourth press roll 12, which is also a shoe press roll and includes a press shoe 12.1. The third and fourth rolls 11 and 12 form a third press nip III with each other.

A fifth press roll 13, which is developed as a suction press roll, forms a fourth press nip IV with the third press roll 11. Press roll 13 is mounted for being displaced towards or away from the third press roll 11, as indicated by the double headed arrow 13.1, so that the press nip IV may be dispensed with, depending upon the operating conditions.

Fourth press roll 12 is located within the endless loop of a second press felt 14. Felt 14, in its turn, is wrapped around guide rolls 15, 16, 17, etc.

Press roll 12 comprises a flexible press jacket which can also have fine recesses on its outer side as shown in dashed line. This design is used particularly in the event that a relatively thin, finely woven press felt 14 is used which has only a relatively slight water absorbing ability.

The fifth press roll 13 is located within the endless loop of a third press felt 18. The felt 18 is moved around guide rolls, including rolls 19, 20.

The wet press is followed in the customary manner by a drying section. A single tier drying section is illustrated. It comprises a plurality of drying cylinders 21, 22, a plurality of deflection suction rolls 23, etc., arranged in each case between two drying cylinders, a drying wire 24 guided by guide rolls 25, 26, etc. The upstream, starting end of the drying section has a deflection suction roll 27, which removes the paper web 4 from the third press felt 18.

Other less important parts include, for instance, a scraper 10.1 associated with the press roll 10 after the second nip, a scraper 11.1 associated with the press roll 11 after the fourth nip, and a broke discharge chute 10.2 located below the press roll 10.

The path of the paper web 4 is as follows. The paper web 4 is first removed from the forming wire 1 by the first press felt 5 and the pick-up roll 7. The web then hangs on the bottom of the first press felt 5. The felt and the web together pass through the first press nip I. Then the web leaves the press felt 5 and remains on the circumference of the press roll 10 until the web passes through the second press nip II. The second nip is felt free. Then the web remains on the circumference of the third press roll 11 until at least the third press nip III is reached, and possibly until the fourth press nip IV. After the fourth press nip, the web is then transferred by means of the deflection suction roll 13 onto the third press felt 18. The web is removed from the felt 18 by the deflection suction roll 27 and is thereafter conducted by the drying section wire 24 through the drying section.

Upon its passage through the wet press from nip I to nip IV, the paper web is constantly adhered to the outer surface of one of the press rolls, so that tearing of the web is practically impossible on this critical section of the travel of the paper web.

It is also important that the first press roll 10 have a relatively soft outer surface in contact with the web, while the second press roll 11 has a relatively hard outer surface in contact with the web. The change from the felted press nip I, formed by a shoe press, to the felt free press nip II, which is formed of completely smooth or closed roll surfaces, and then to the felted press nip III, which is formed again by a shoe press, has also proven particularly favorable. Press felt 18 is preferably formed of a relatively fine fabric, so that the paper web 4 is marked relatively little by the press felt 18 at the last press nip IV, if such a nip is present. In other words, the bottom side of the paper web 4 remains relatively smooth upon contact with the press felt 18.

Figure 2:
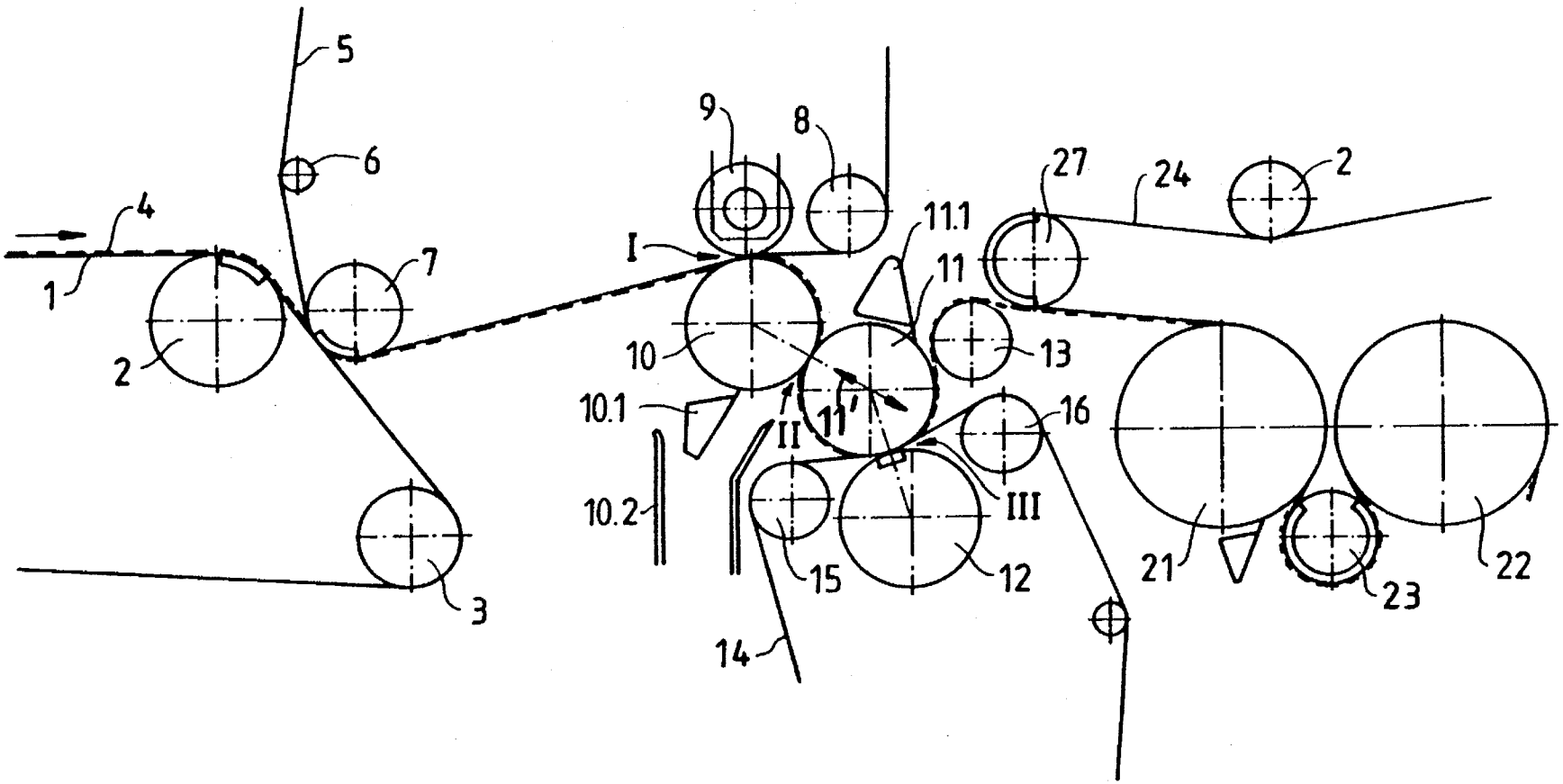
FIG. 2 shows a press section having a four roll press, including one shoe press.

The embodiment shown in FIG. 2 is similar to that shown in FIG. 1. Again, there is a wire section with the moving wire 1, the wire suction roll 2, the deflection roll 3 and the paper web 4, shown in dashed line, which is carried on the wire 1. A first press felt 5 conducts the paper web 4 through a first press nip I between the first and second press rolls 9 and 10. Roll 9 is a press roll with a smooth, i.e. closed, outer surface, and not a shoe press as in FIG. 1. Alternatively, the outer surface of the first press roll 9 can also be provided with fine recesses, for instance circumferential grooves, for the temporary storage of water. The remaining structure of the press is also very similar to that shown in FIG. 1. However, roll 13 directly contacts the web and therefore has a closed outer surface. In other words, there is no felt like belt 18 around the roll 13, and the web is not supported by a felt as it moves to the roll 27. The paper web 4 is transferred from the roll 13 onto the drying section wire 24, at a suction zone of roll 27.

Figure 3:
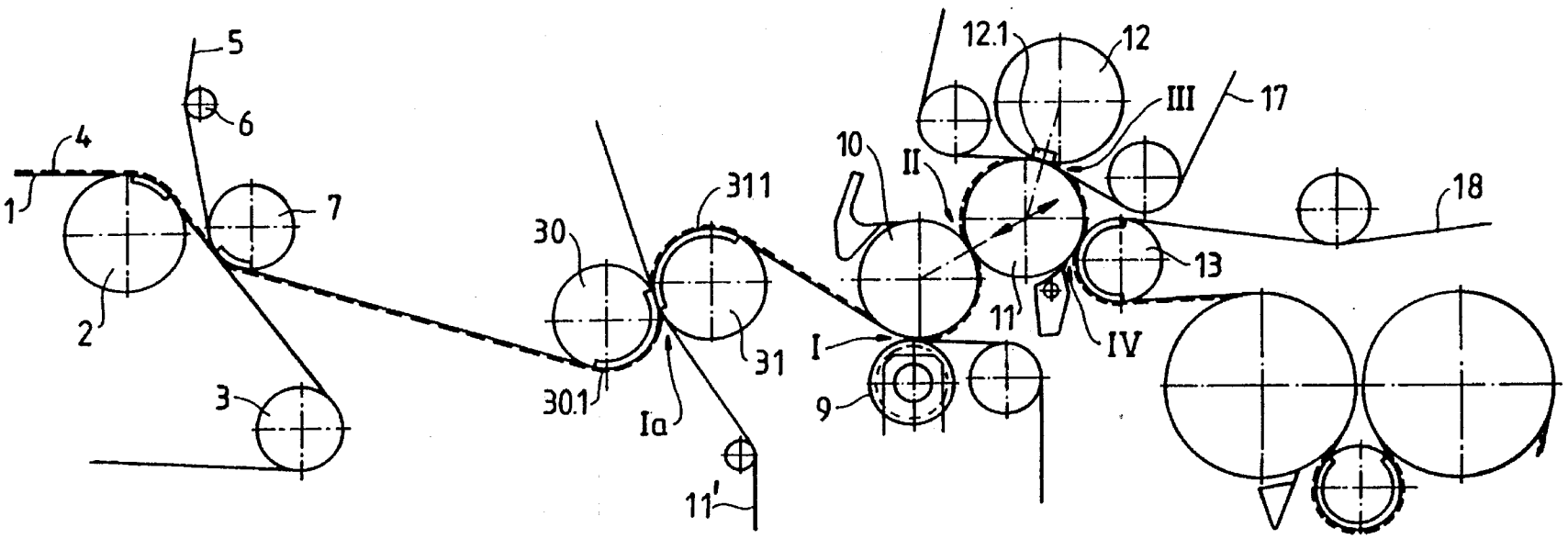
FIG. 3 shows a press section which contains, inter alia, a five roll press, wherein one of the rolls is a shoe press roll.

The embodiment shown in FIG. 3 is similar to the first two, except for what follows the pick-up roll 7. This roll is followed by an initial press having a press roll nip Ia which is formed of two press rolls 30 and 31. Press roll 30 has a suction zone 30.1 to conduct the paper web 4 dependably to the press nip Ia. Press roll 31 has a suction zone 31.1 in order to transfer the paper web 4 reliably to a second press felt 11'.

The following press again has five press rolls 9, 10, 11, 12, and 13. The first roll 9 has a smooth or a grooved surface and is also located within the loop of the second felt 11'. Together with the second roll 10, the first roll 9 forms a first press nip I. The second and third rolls 10 and 11 form a second press nip II. The third and fourth rolls 11 and 12 form a third press nip III. The third and fifth rolls 11 and 13 form a fourth press nip IV.

The fourth roll 12 is located within the loop of a third press felt 17. The fifth roll 13 is at the same time a suction deflection roll which transfers the paper web onto a drying wire 18 of the following drying section. The drying section basically has the same construction as the drying sections of the other two embodiments.

In the press of the invention, comprising the press rolls 9–13, on its course from the first press nip I to the last press nip IV, the paper web always follows the circumferences of the press rolls concerned. The web thus never travels freely. In FIG. 3 also, the second press nip II of the press is formed of a roll with a relatively soft jacket, the roll 10, and of a roll with a hard jacket, the roll 11. The roll 10 having the soft jacket is arranged upstream of the roll 11 having the hard jacket, as seen in the direction of travel of the paper web 4. Roll 12 with a press jacket which is smooth on the outside or which is provided with recesses, is again a shoe press roll having a shoe 12.1.

Figure 4:
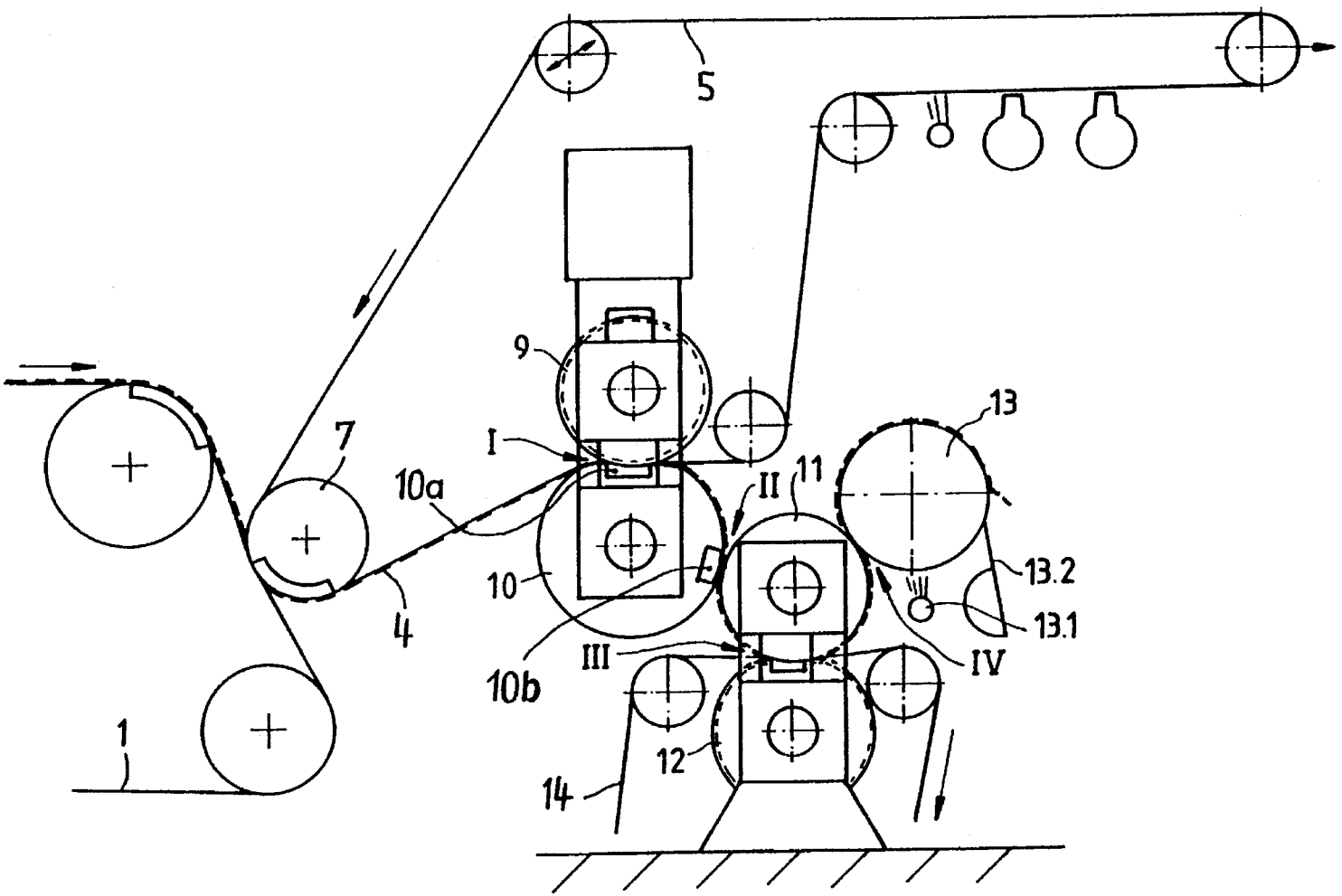
FIG. 4 shows a press section having a five roll press, including two shoe press rolls.

The embodiment shown in FIG. 4 is similar to the first two embodiments shown in FIGS. 1 and 2 because the five press rolls shown provide the only press and there is no two roll press in front of it. However, it is obvious that this arrangement could also be altered. A further press could be arranged either upstream or downstream of the illustrated press.

The five press rolls 9, 10, 11, 12, 13 in FIG. 4 form a total of four press nips I, II, III, IV with each other. Differing from FIGS. 1 and 2, the first press roll 10 which is contacted by the paper web without a felt interposed is now a shoe press roll, and the tubular, flexible rotating press jacket of that shoe press roll is smooth. The roll 10 has a radially movable press shoe 10*a*, with a concave pressing surface, which forms the press nip I with the preferably grooved press roll 9. Furthermore, the shoe press roll 10 has a radially movable ledge 10*b*, preferably with a convex pressing surface, located at the press nip II. The ledge 10*b* is movable for opening or closing the press nip II and for varying the pressing force in the press nip II. Due to the movable ledge 10*b*, the press roll 11 need not be adjustable in its position, which differs from the embodiments of FIGS. 1 to 3. In other words, the four press rolls 9 to 12 can all be supported substantially rigidly on a foundation or on a machine frame. This provides an extremely simple, space saving arrangement of the entire wet press.

The paper web 4 is removed by the press felt 5 and the pick-up roll 7 from the wire 1 and the web is then passed, together with the felt 5, though the first press nip I. On the other hand, the paper web 4 passes by itself through the second press nip II, i.e. without a felt. At the press nip III, the condition is the same as at the press nip I, as the paper web 4 and a felt 14 pass together through the press nip III. Press nip IV passes the web alone without a felt, as in the case of the press nip II. The paper web 4 travels by itself through this press nip. This alternate guidance of the web, first with, then without, then again with and finally without a felt, is advantageous. The pressing with a felt permits relatively strong removal of water but the felt has the disadvantage of the marking the moist paper web with the felt fabric pattern, while the following press nip without a felt smoothes out the preceding felt marking.

A spray tube 13.1 is associated with the press roll 13. It applies a water spray mist onto the outer surface of the roll 13 over the entire width of the roll, shortly upstream of the press nip IV. This assures that, if necessary, the paper web continues to travel with the roll 13 after leaving the press nip IV. A scraper 13.2 cleans the outer surface of the roll 13.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A wet press for a paper making machine for pressing moisture from a moist paper web, the press comprising:

a plurality of press rolls, each press roll having an outer surface; the press rolls being arranged so that the rolls define pairs which form respective press nips between the rolls of each pair of rolls, the plurality of press rolls being of such number and being so structured and arranged that there are at least four successive press nips in the wet press along the web path;

the press rolls being so placed as to guide the web so that the web passing through the wet press is continuously supported by the outer surfaces of successive press rolls on the web path from the first of the press nips formed between one pair of the rolls to the last of the press nips formed by another pair of the rolls;

the second and fourth press nip in succession on the web path being free of a felt passing through the respective press nip; each of the press rolls defining the second and fourth press nip having a closed outer surface;

the first press nip including a shoe press roll as one of the press rolls, the shoe press roll having a concave press shoe which forms the first press nip along the web path in cooperation with another one of the press rolls;

the shoe press roll having a ledge which forms the second press nip in cooperation with another press roll having a smooth closed outer surface;

a felt passing through each of the first and the third of the press nips along the web path;

one of the press rolls defining the third press nips including a shoe press; and means supporting the web for bringing it to the first of the press nips along the web path and further means supporting the web and bringing it away from the last of the press nips along the web path.

2. The wet press of claim 1, wherein the shoe press roll of the second press nip along the web path has a relatively soft outer surface which is in engagement with one side of the web, the other press roll of the second press nip having a relatively hard outer surface in engagement with the opposite side of the web; the other press roll being arranged downstream of the shoe press roll along the web path.

3. The wet press of claim 1, further comprising a spray tube directed for spraying moisture onto the peripheral surface of one press roll just upstream of the fourth press nip formed by the one press roll and another of the press rolls.

4. The wet process of claim 1, wherein the means carrying the web to the first press nip comprises the felt which passes through the first press nip;

a wire for delivering the web to the press from upstream of the first press roll in the web path; a pickup roll at the wire, the web being trained over the pickup roll and extending toward the first press nip in order to remove the paper web from the wire over the pickup roll so that the felt can deliver the web to the first press nip.

5. The wet press of claim 1, further comprising a scraper at one of the press rolls defining the fourth press nip for cleaning the outer surface.

* * * * *